US006788259B2

(12) United States Patent
Amano et al.

(10) Patent No.: US 6,788,259 B2
(45) Date of Patent: Sep. 7, 2004

(54) ANTENNA STRUCTURE AND MOBILE TERMINAL HAVING ANTENNA STRUCTURE

(75) Inventors: Takashi Amano, Soka (JP); Norimichi Chiba, Hino (JP); Hisao Iwasaki, Tama (JP); Hiromichi Suzuki, Hino (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/028,792

(22) Filed: Dec. 28, 2001

(65) Prior Publication Data

US 2002/0086646 A1 Jul. 4, 2002

(30) Foreign Application Priority Data

Jan. 4, 2001 (JP) ..... 2001-000203

(51) Int. Cl.[7] ..... H01Q 1/24

(52) U.S. Cl. ..... 343/702; 343/700 MS; 343/860; 343/893

(58) Field of Search ..... 343/700 MS, 702, 343/820, 822, 895, 860, 893, 901

(56) References Cited

U.S. PATENT DOCUMENTS

| | | | | |
|---|---|---|---|---|
| 5,717,409 A | | 2/1998 | Garner et al. | 343/702 |
| 5,995,064 A | * | 11/1999 | Yanagisawa et al. | 343/895 |
| 6,069,592 A | * | 5/2000 | Wass | 343/895 |
| 6,380,900 B1 | * | 4/2002 | Kanayama | 343/702 |
| 6,396,458 B1 | * | 5/2002 | Cockson et al. | 343/860 |
| 6,424,302 B1 | * | 7/2002 | Wu | 343/702 |
| 2002/0008663 A1 | * | 1/2002 | Suguro et al. | 343/700 MS |

FOREIGN PATENT DOCUMENTS

| | | |
|---|---|---|
| WO | WO 94 10720 A | 5/1994 |
| WO | WO 97 42680 | 11/1997 |
| WO | WO 97 49141 | 12/1997 |
| WO | WO 00 30208 A | 5/2000 |
| WO | WO 01 11721 A | 2/2001 |

OTHER PUBLICATIONS

Patent Abstracts of Japan, vol. 018, No. 188 (E–1532), Mar. 31, 1994, & JP 05 347507 A (Junkosha Co. Ltd.), Dec. 27, 1993.

* cited by examiner

*Primary Examiner*—Shih-Chao Chen
(74) *Attorney, Agent, or Firm*—Oblon, Spivak, McClelland, Maier & Neustadt, P.C.

(57) ABSTRACT

A flexible substrate having a meandering antenna element and a matching circuit formed thereon is wound within an antenna cap and mounted on a terminal body. A rod-like antenna is arranged extensible within the flexible substrate. If the rod-like antenna is withdrawn, a linear antenna element is coupled by a capacitive coupling with the matching circuit formed on the flexible substrate. Also, if the rod-like antenna is returned into the terminal body, the capacitive coupling between the linear antenna element and the matching circuit is released, and the meandering antenna element is coupled by a capacitive coupling with the matching circuit on the flexible substrate.

8 Claims, 10 Drawing Sheets

ANTENNA STRUCTURE AND MOBILE TERMINAL HAVING ANTENNA STRUCTURE

CROSS-REFERENCE TO RELATED APPLICATIONS

This application is based upon and claims the benefit of priority from the prior Japanese Patent Application No. 2001-000203, filed Jan. 4, 2001, the entire contents of which are incorporated herein by reference.

BACKGROUND OF THE INVENTION

1. Field of the Invention

The present invention relates to an antenna structure and a mobile terminal having the particular antenna structure, particularly, to an antenna structure adapted for use in, for example, a cellular, mobile or PHS (Personal Handy-Phone System) phone or terminal.

2. Description of the Related Art

Mobile phones or terminals are generally provided in general with an antenna, for receiving a high frequency signal from a radio station and for transmission a high frequency signal to the radio station. The antenna employs, in general, an antenna structure constructed to enable extension and retraction of antenna, and is capable of receiving a high frequency signal in the retracted state.

In the antenna structure, a helical first antenna section having a first contact point section is arranged in the mobile terminal body, and a second antenna section having a second contact point section, connected to the first antenna in the longitudinal direction, is housed extensible in the mobile terminal body. When the second antenna section is housed in the mobile terminal body, the helical section alone of the first antenna protrudes from the mobile terminal body, and the first contact point section of the first antenna is connected to the power supply section, with the result that power is supplied to the first antenna section. Also, when the second antenna section is extended from within the mobile terminal body, the second contact point section of the second antenna section is connected to the second contact point section, with the result that power is supplied to the second antenna section. It follows that a high frequency signal can be transmitted and received between the mobile terminal and the radio station whether the antenna is extended or retracted.

As such an antenna, use is made of a monopole antenna having a length of $\lambda/4$, $3\lambda/8$ and $5\lambda/8$, where $\lambda$ represents the wavelength of the high frequency signal that is transmitted or received.

On the other hand, proposed as an antenna satisfying the demands in recent years for the broad band width and for high gain is a so-called "self-resonant" type antenna, of a length $\lambda/2$. This type of antenna has a radiation directivity equal to that of a $\lambda/2$ dipole antenna, non-directive and a high gain characteristic in a horizontal plane. Thus, the self-resonant type can be applied to a so-called "viewer type" mobile terminal on which a large liquid crystal screen is mounted so as to make it possible for the user to transmit and receive data, such as character data, still and moving image data, while observing the liquid crystal screen.

Also, in the self-resonant type antenna, it is impossible to directly connect the power supply point of the antenna to a radio frequency circuit section so as to supply a power to the antenna, because the self-resonant type antenna has high impedance at the bottom end thereof. Thus, the antenna is preferably coupled to the radio frequency circuit section via a matching circuit of weak magnetic field coupling type to reduce the Q factor and to increase the bandwidth. The antenna is more preferably coupled to the radio frequency circuit via a matching circuit of $\lambda/2$ capacitive-coupling type, which has a line of $\lambda/4$. This self-resonant type antenna can realize a characteristics having two resonant points and a more broader bandwidth, which is referred to herein after as a $\lambda/2$ capacitive-coupling antenna.

As a retractable antenna, there is known a bottom helical structure in which a helical antenna as the first antenna is fixed in the housing of the mobile terminal, when the extensible antenna as the second antenna is pulled up from the housing.

A $\lambda/2$ capacitive-coupling antenna having the bottom helical structure is disclosed in U.S. Pat. No. 5,717,409, issued Feb. 10, 1998, Garner et al, which has a configuration as shown in FIG. 1. In the mobile terminal shown in FIG. 1, a radio transmission section 3 is arranged within a terminal body 2. An antenna cap 5C is erected on the terminal body 2, and an antenna element 5D constituting an antenna in the retracted state is spirally arranged in the axial direction of the antenna within the antenna cap 5C. Also, a cylindrical frame 5F having a spiral matching circuit element 5E formed on the circumferential wall is coaxially arranged within the antenna element 5D.

An extensible antenna 5G (movable in the direction denoted by the arrows A and B) when extended, is capable of being housed in the cylindrical frame 5F with a sleeve 5H interposed therebetween. If the antenna 5G is extended from the housing or terminal body 2, the antenna 5G is capacitively coupled with the matching circuit element 5E via a capacitive coupling section 5I of the sleeve 5H. Also, if the antenna 5G is housed in the terminal body 2, the antenna element 5D, not the antenna 5G is capacitively coupled with the matching circuit element 5E.

In the $\lambda/2$ capacitive coupling antenna, however, it is necessary to coaxially mount the antenna element 5D and the matching circuit element 5E, leading to the problem that the construction of the antenna is rendered highly complex.

As described above, the construction of the conventional antenna is highly complex.

BRIEF SUMMARY OF THE INVENTION

An object of the present invention is to provide an antenna structure simple in structure and capable of increasing the bandwidth and increasing the gain, and to provide a mobile terminal equipped with the particular antenna structure.

According to a first aspect of the present invention, there is provided an antenna structure arranged in a mobile terminal having a body including a holding section configured to hold an antenna structure and a mobile terminal circuit section housed in the body, comprising:

a flexible substrate mounted within the holding section;

a meander-shaped antenna pattern formed on the flexible substrate;

a matching circuit element configured to substantially match the impedances of the antenna pattern and a mobile terminal section; and a capacitive coupling element configured to achieve a capacitive coupling between the antenna pattern and the matching circuit.

According to a second aspect of the present invention, there is provided an antenna structure arranged in a mobile terminal having a body including a holding section configured to hold an antenna structure and a mobile terminal circuit section housed in the body, comprising:

a first antenna element extending substantially linearly;

an antenna support mechanism configured to support the first antenna element, arranged within an antenna holding section, and to permit the first antenna element to be withdrawn from a body of a mobile terminal and to be brought back into the body so as to be housed in the body;

a flexible substrate mounted within the holding section and arranged around the first antenna element withdrawn from the body;

a second antenna pattern formed bent on the flexible substrate;

a matching circuit configured to permit the impedance of the first antenna element to be matched with the impedance of the radio transmission section of the second antenna pattern; and a capacitive coupling element configured to permit the first antenna element and the second antenna pattern to be coupled with the matching circuit by a capacitive coupling.

According to a third aspect of the present invention, there is provided a mobile terminal, comprising:

a first antenna element extending substantially linearly and having an antenna axis;

a body including a housing section for housing the first antenna element;

an antenna support mechanism configured to support the first antenna element, housed in the housing section, and to permit the first antenna element to be withdrawn from the body of a mobile terminal along the antenna axis and to be brought back into the body along the antenna axis so as to be housed in the body;

a flexible substrate mounted within the housing section and arranged around the first antenna element withdrawn from the body;

a second antenna pattern formed bent on the flexible substrate;

a mobile terminal circuit mounted within the body and configured to receive and transmit a mobile terminal signal through the first antenna element and the second antenna pattern;

a matching circuit element configured to permit the impedance of the first antenna element to be matched with the impedance of the mobile terminal circuit section of the second antenna pattern; and a capacitive coupling element configured to permit the first antenna element and the second antenna pattern to be coupled with the matching circuit by a capacitive coupling.

Further, according to a fourth aspect of the present invention, there is provided a mobile terminal, comprising:

a flexible substrate;

a body including a housing section for housing the flexible substrate, the housing section protruding from the body along a first reference axis;

an antenna pattern formed bent on the flexible substrate, the antenna pattern extending in a meandering fashion along a second reference axis, and the first and second reference axes forming an angle falling within a range of between 45° and 90°;

a mobile terminal circuit housed in the body and configured to receive and transmit a mobile terminal signal through the antenna pattern;

a matching circuit element configured to permit the impedance of the antenna pattern to be matched with the impedance of the mobile terminal circuit section; and a capacitive coupling element configured to permit the second antenna pattern to be coupled with the matching circuit by a capacitive coupling.

Additional objects and advantages of the present invention will be set forth in the description which follows, and in part will be obvious from the description, or may be learned by practice of the present invention. The objects and advantages of the present invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the present invention, and together with the general description given above and the detailed description of the embodiments given below, serve to explain the principles of the present invention.

DETAILED DESCRIPTION OF THE INVENTION

Mobile phone terminals, equipped with an antenna structure according to an embodiment of the present invention, will now be described in detail with reference to the accompanying drawings.

Figure 1:
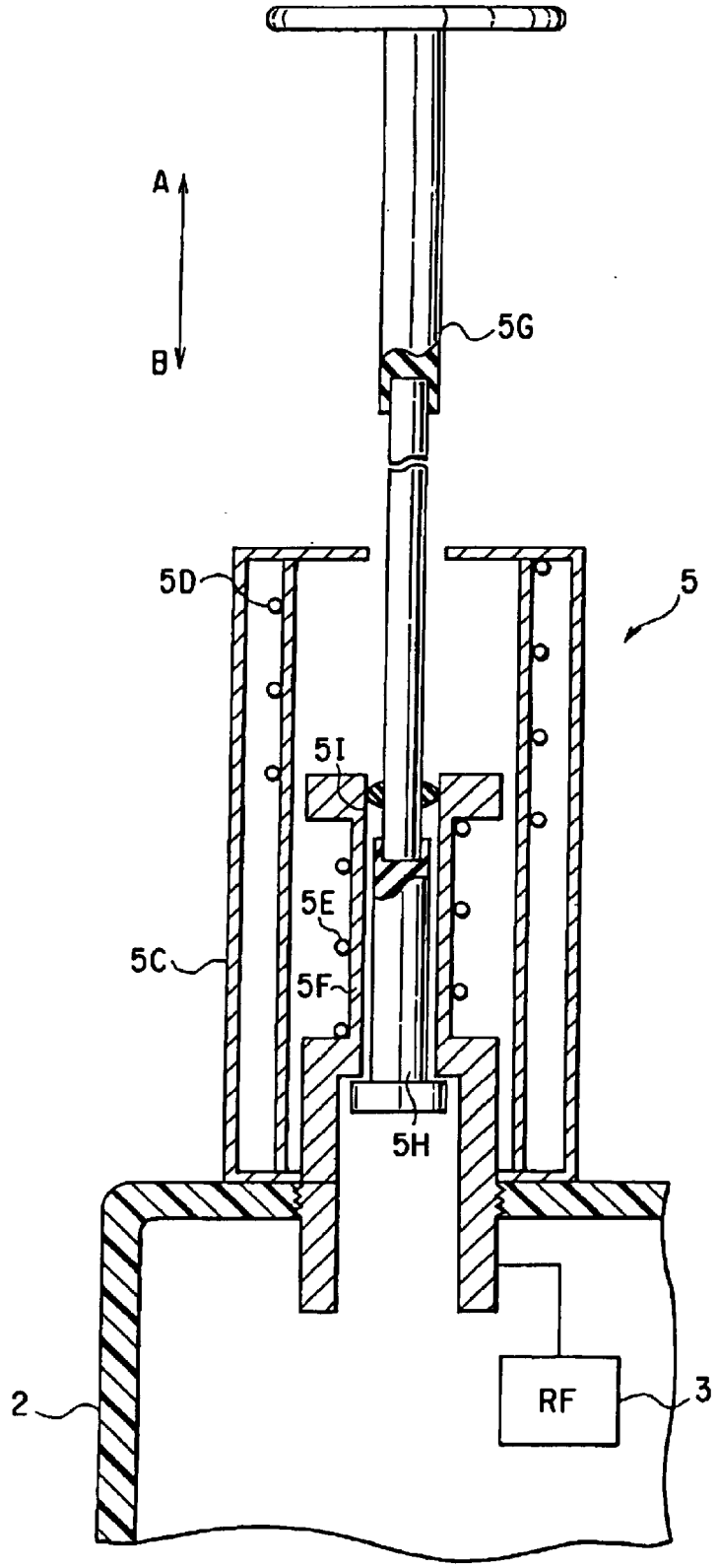
FIG. 1 PRIOR ART
FIG. 1 is a cross sectional view, partly broken away, schematically showing a mobile terminal equipped with a conventional antenna having a bottom helical structure.
Figure 2:
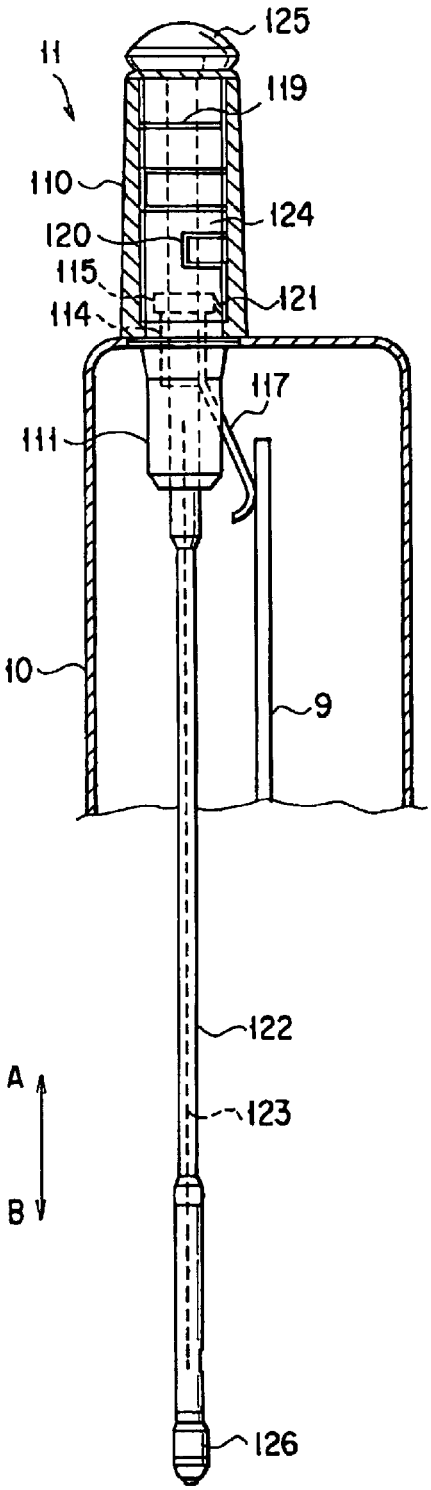
FIG. 2 is a cross sectional view, partly broken away, schematically showing a mobile terminal equipped with an antenna according to one embodiment of the present invention.
Figure 3:
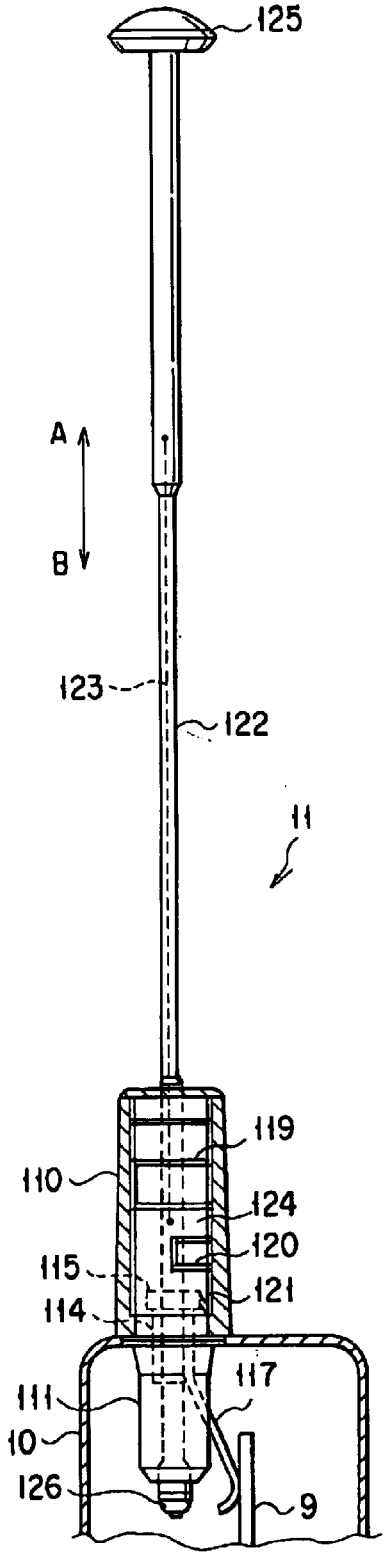
FIG. 3 is a cross sectional view, partly broken away, schematically showing the mobile terminal of FIG. 2 with the rod-like antenna extended.

FIGS. 2 and 3 collectively show an antenna structure according to one embodiment of the present invention, and a mobile terminal equipped with the particular antenna structure. Specifically, FIG. 2 shows the antenna is in a retracted state in a body 10 of the mobile terminal, and FIG. 3 shows the extended state of the antenna.

Figure 4:
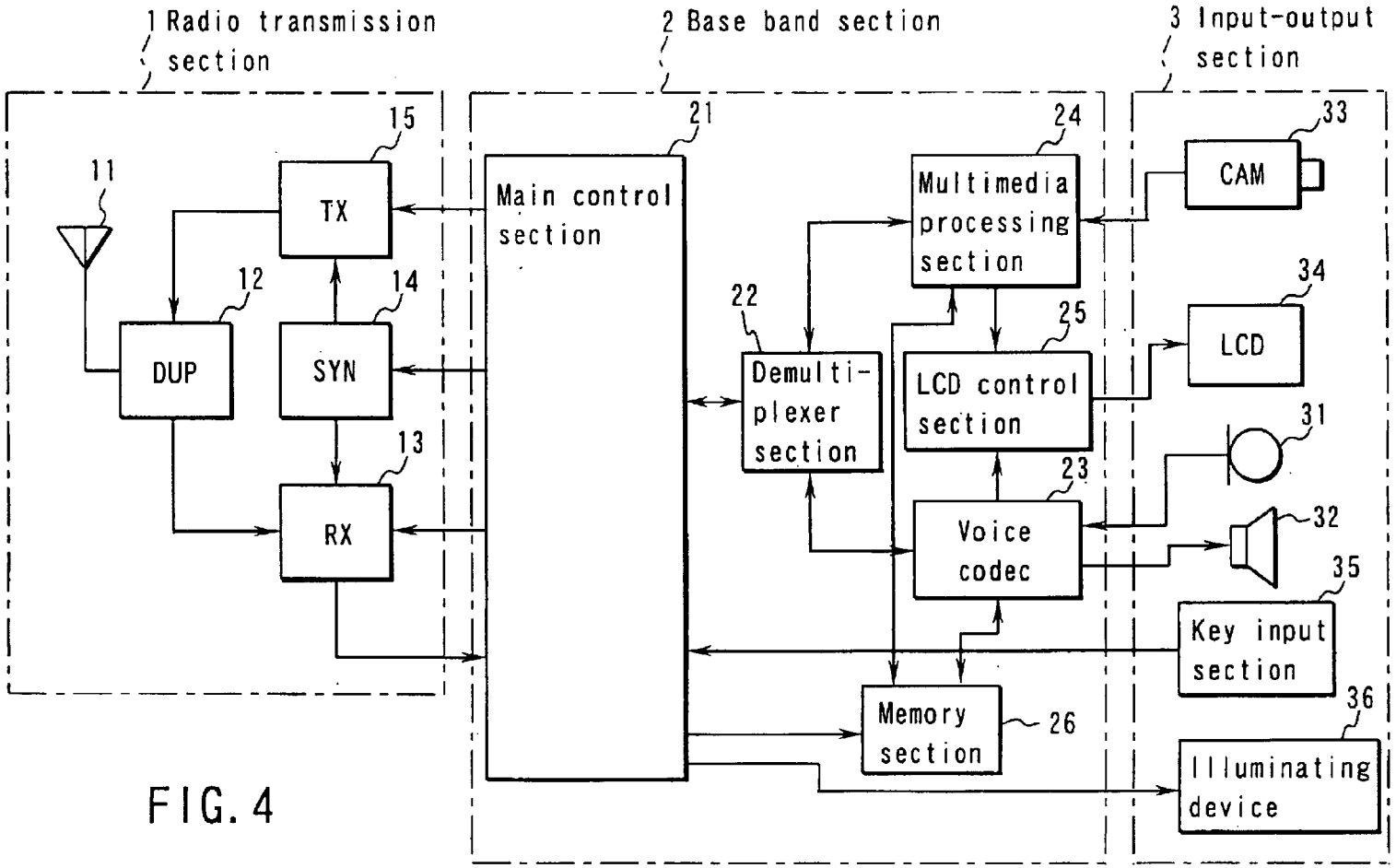
FIG. 4 is a block diagram schematically showing the circuit formed on the printed circuit board shown in FIG. 2.

A printed circuit board 9 having a radio transmission section 1, a base band section 2, and an input-output section 3 formed thereon as shown in FIG. 4 is arranged in the terminal body 10 as shown in FIGS. 2 and 3.

In the circuit shown in FIG. 4, a high frequency radio signal transmitted from a radio station (not shown) is received by a retractable antenna 11, and supplied to a receiver (RX) 13 through a duplexer (DUP) 12. The receiver 13 includes a high frequency amplifier, a frequency converter and a demodulator. In the receiver (RX) 13, the radio transmission signal is so amplified as to suppress a generation of noises in a low noise high frequency amplifier and is mixed, in the frequency converter, with a local oscillation signal generated from a frequency synthesizer (SYN) 14 and the mixed signal is down-converted into an intermediate frequency signal or a base band signal. Also, the output signal is demodulated into a digital signal by the demodulator. Employed as the demodulation scheme is, for example, an orthogonal demodulation scheme corresponding to a QPSK (Quadrature PSK) scheme and a spectrum de-spreading scheme using a diffusion code. Incidentally, the frequency of the local oscillation signal generated from the frequency synthesizer 14 noted above is controlled by a main control section 21 arranged in the base band section 2.

The demodulation signal generated from the demodulator is supplied to the base band section 2. The base band section 2 comprises the main control section 21, a demultiplexer 22, a voice codec 23, a multimedia processor 24, an LCD controller 25, and a memory section 26.

It is discriminated in the main control section 21 whether the demodulation signal represents control information or a multimedia signal. If the demodulation signal represents multimedia information, the demodulation signal is supplied into a multiplex separating section 22 and separated into voice data and image data. The voice data is input to the voice codec 23 so as to be restored into voice signals. As a result, the voice signals are converted into voice, which is generated from a loud speaker 32 included in the input-output section 3. On the other hand, the image data is supplied to the multimedia processor 24 so as to be processed to generate image signals. The image signals thus regenerated are supplied to an LCD 34 included in the input-output section 3 via the LCD control section 25, with the result that an image is displayed on the LCD 34.

Incidentally, the received image data is stored in a RAM arranged in the main control section 21. Also, various information denoting the operating state of the apparatus, which is generated from the main control section 21, e.g., the telephone book, the detected electric field intensity of the received signal, and the residual amount of the battery, is also displayed on the LCD 34.

On the other hand, the speech signal of the user generated from a microphone 31 included in the input-output section 3 is supplied to the voice codec 23 of the base band section 2 so as to be coded as voice and, then, supplied to the demultiplexer 22. Also, an image signal generated from a camera (CAM) 33 is supplied to the multimedia processor 24 included in the base band section 2 so as to be subjected to a coding process and, then, supplied to the demultiplexer 22. In the demultiplexer 22, the coded voice data and the coded image data are multiplexed in a predetermined format. The transmission data thus multiplexed is supplied from the main control section 21 into a transmitting circuit (TX) 15 included in the radio transmission section 1.

The transmitting circuit 15 includes a modulator, a frequency converter and a transmission power amplifier. The transmission data is modulated into digital signals in the modulator and, then, mixed in the frequency converter, with a local oscillation signal generated from the frequency synthesizer 14 to down convert into a radio transmission frequency signal. A QPSK scheme and a spectrum diffusion scheme using a diffusion code are employed as the modulation scheme. The radio transmission frequency signal thus generated is amplified to a predetermined level by the power amplifier, supplied to the antenna 11 through the duplexer 12 and, then, transmitted to a radio station (not shown) from the antenna 11.

Arranged in the input-output section 3 is an illuminating device 36 for illuminating the LCD 34 and a key input section 35 during operation. The illuminating device 36 is called, for example, a "back light" or "illumination".

The retractable antenna 11 for transmission and receiving a mobile terminal signal to and from the radio station referred to previously will now be described.

Figure 5:
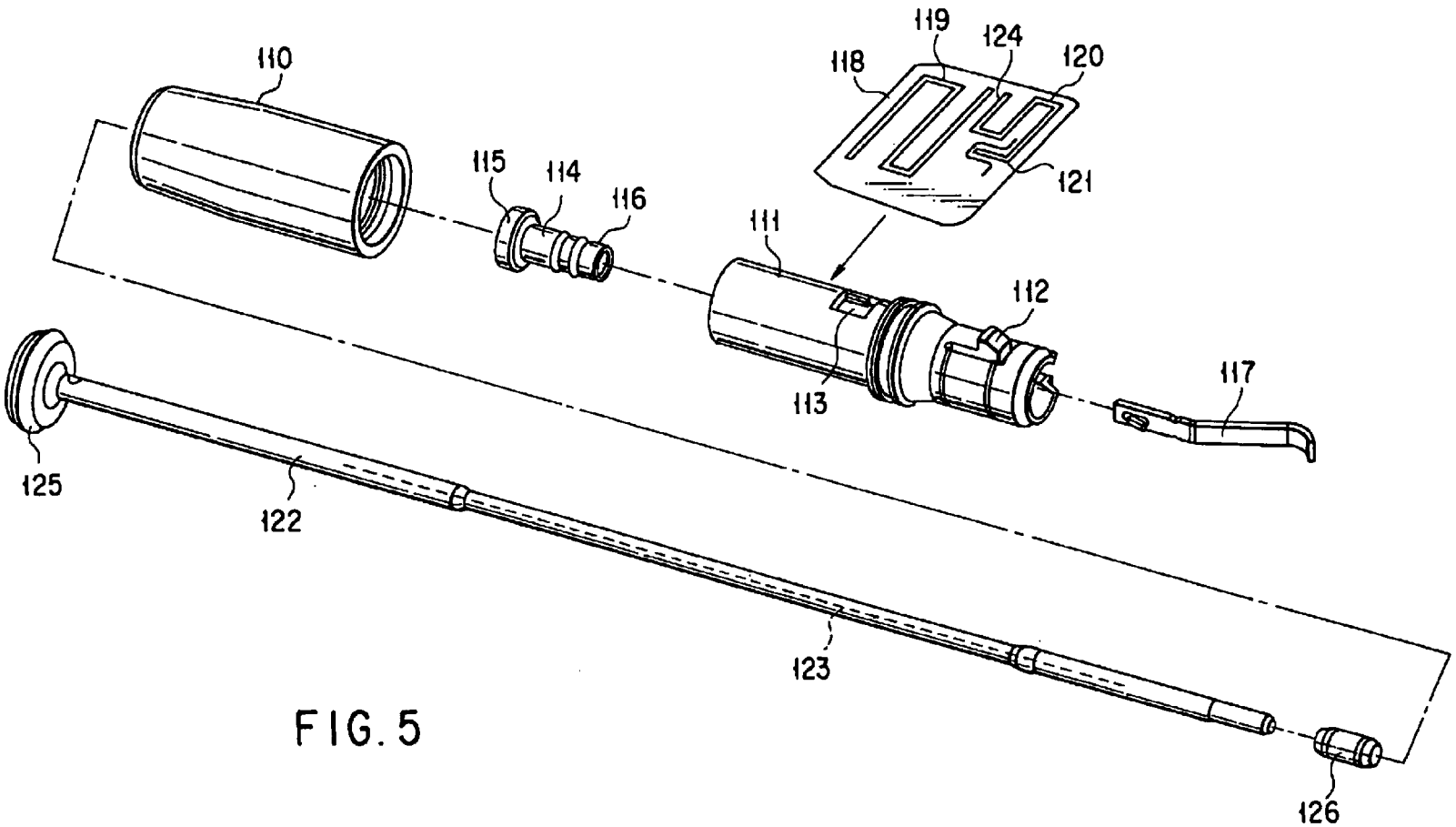
FIG. 5 is an oblique view schematically showing, in a dismantled fashion, the construction of the antenna shown in FIG. 2.

As shown in FIGS. 2 and 3, a cylindrical antenna cap 110 supporting the antenna and made of a nonmetallic material is fixed to the body 10 of the mobile terminal in an upward-protruding manner. As shown in FIG. 5, a cylindrical frame 111 made of a non-metallic material is housed in the antenna cap 110. An elastic engaging section 112 is mounted to the frame 111. The elastic engaging section 112 (not shown in FIGS. 2 and 3) is elastically engaged with the terminal body 10 so as to permit the antenna cap 110 to be mounted to the terminal body 10.

A slot 113 (not shown in FIGS. 2 and 3) is formed in the cylindrical frame 111, and a cylindrical sleeve 114 made of a metallic material is inserted into the cylindrical frame 111. A flange-like connecting section 115 is formed in the proximal end portion of the sleeve 114 in a manner to correspond to the slot 113 of the frame 111, and a power supply pin coupling section 116 for supplying the transmission power is formed in the distal end portion of the sleeve 114. One end of a power supply pin 117 is coupled with the power supply pin coupling section 116, and the other end of the power supply pin 117 is electrically connected to the DUP 12 in the radio transmission section 1 formed on the printed circuit board 9.

A flexible substrate 118 is wound about the cylindrical frame 111 by utilizing the flexibility of the substrate 118. An antenna element 119 corresponding to a second antenna, which is utilized when the antenna is housed in the body 10, and a matching circuit 120 for impedance matching, are formed on the flexible substrate 118 in a predetermined pattern, e.g., in a meandering pattern, so as to be arranged between the frame 111 and the antenna cap 110. A power supply terminal 121 of the matching circuit 120 is electrically connected to the connecting section 116 of the sleeve 114 through the slot 113, and the sleeve 114 is electrically connected via the power supply pin 117 to the DUP 12 of the radio transmission section 1 formed on the printed circuit board 9.

It should be noted that the meandering antenna element 119 is formed on the flexible substrate 118 such that the total length of the antenna element 119 is equal to λ/2. Also formed on the flexible substrate 118 is the matching circuit 120 such that the sum of the lengths of the matching circuit 120 and the length of the power supply pin 117 is equal to λ/4. Further, a capacitive coupling section 124 for capacitive-coupling between the matching circuit 120 and the meandering antenna element 119 is formed on the flexible substrate 118 so as to be positioned between the matching circuit 120 and the antenna element 119.

A rod-like antenna 122 corresponding to a first antenna is retractably arranged in the sleeve 114 (movable in the direction denoted by the arrows A and B in FIGS. 2 and 3). A linear antenna element 123 having a length corresponding to λ/2 is coaxially arranged on the rod-like antenna 122 with the meandering antenna element 119 formed on the flexible substrate 118. When the antenna 11 is extended as shown in FIG. 3, the proximal end of the linear antenna element 123 is electrically connected to the capacitive coupling section 124 formed on the flexible substrate 118, with the result that the linear antenna element 123 is electrically connected to the matching circuit 120. Also, the rod-like antenna 122 is provided at one end with a first stopper 125 which is abutted to the top portion of the antenna cap 110 to regulate the retracted position of the rod-like antenna 122 when retracted, and is also provided at the other end with a second stopper 126 which is also abutted to the bottom portion of the frame 111 to regulate the extended position of the rod-like antenna 122 when the rod-like antenna 122 is extended.

If the rod-like antenna 122 is pushed in the direction of the arrow B in the antenna structure described above, the first stopper 125 abuts against the portion of the antenna cap 110 so as to permit the rod-like antenna body 122 to be housed in the terminal body 10.

When the antenna is housed in the terminal body 10, the edge portion on the upper side of the linear antenna element 123 of the rod-like antenna 122 is positioned away from the capacitive coupling section 124 of the matching circuit 120 formed on the flexible substrate 118 so that the capacitive coupling section 124 is electrically disconnected. Also, when the antenna is housed in the terminal body 10, the meandering antenna element 119 on the flexible substrate 118 is electrically connected to the matching circuit 120 via the capacitive coupling section 124. Further, when the antenna is housed in the terminal body 10, the meandering antenna element 119 is electrically connected to the DUP 12 included in the radio transmission section 1 formed on the printed circuit board through the matching circuit 120, the sleeve 114 and the power supply pin 117, so as to execute the transmission-reception of the signal by the so-called "λ/2 capacitive coupling antenna".

Also, if the rod-like antenna 122 is extended in the direction of the arrow A, the second stopper 126 abuts against the edge portion of the frame 111, thereby limiting the extension of the rod-like antenna 122.

Under the extended state of the rod-like antenna 122, the lower edge portion of the linear antenna element 123 of the rod-like antenna 122 is electrically connected to the capacitive coupling section 124 of the matching circuit 120 formed on the flexible substrate 118 so as to be electrically connected to the DUP 12 included in the radio transmission section 1 on the printed circuit board 9 via the matching circuit 120, the sleeve 114 and the power supply pin 117, thereby executing the transmission-reception of the signal by the λ/2 capacitive coupling antenna.

When the rod-like antenna 122 is extended, the meandering antenna element 119 on the flexible substrate 118 is electrically connected to the matching circuit 120 via the capacitive coupling section 124. However, since the coupling capacitance is small, the rod-like antenna 122 is substantially connected electrically to the matching circuit 120 via the capacitive coupling section 124 so as to permit the linear antenna element 123 of the rod-like antenna 122 to execute transmission-reception of the signal.

As described above, in the antenna structure described above, the flexible substrate 118 having the meandering antenna element 119 and the matching circuit 120 formed thereon is mounted within the antenna cap 110 so as to be incorporated in the terminal body 10. Also, the rod-like antenna 122, arranged protrusibly within the flexible substrate 118 is housed protrusibly within the terminal body 10, so as to achieve or release the capacitive coupling between the linear antenna element 123 of the rod-like antenna 122 and the matching circuit 120 on the flexible substrate 118 in accordance with the extension or retraction of the rod-like antenna 122. It follows that the linear antenna element 123 performs the function of the retractable antenna in cooperation with the meandering antenna element 119 formed on the flexible substrate 118.

In the antenna structure described above, the flexible substrate 118 having the meandering antenna element 119 and the matching circuit 120 formed thereon is wound about the terminal body 10 with the antenna cap 110 interposed therebetween. The retractable antenna structure can be achieved by the simple construction that the rod-like antenna 122 is simply housed in the flexible substrate 118, which is wound to form the bottom helical structure of the λ/2 capacitive coupling type, permitting an increase in the bandwidth and gain.

Also, in the mobile terminal described above, the flexible substrate 118 having the meandering antenna element 119 and the matching circuit 120 formed thereon is wound within the antenna cap 110 so as to be mounted in the terminal body 10. Also, the rod-like antenna 122 arranged protrusibly within the flexible substrate 118 is housed protrusibly so as to achieve or release the capacitive coupling between the linear antenna element 123 of the rod-like antenna 122 and the matching circuit 120 formed on the flexible substrate 118 in accordance with the extension and retraction of the rod-like antenna 122. It follows that the retractable antenna structure is capable of transmission-reception of the signal in cooperation with the meandering antenna element 119 formed on the flexible substrate 118.

According to the present invention, a retractable antenna of the capacitive coupling type with the bottom helical structure of the λ/2, which permits increasing the band width and the gain, can be achieved by a simple construction in which the flexible substrate 118, having the meandering antenna element 119 and the matching circuit 120 formed thereon, is arranged in the antenna cap 110 interposed therebetween, and the rod-like antenna 122 is retractably housed within the wound flexible substrate 118. As a result, it is possible to realize easily the so-called "viewer type" terminal structure for performing the transmission-reception of data such as the still and moving image data.

The mobile terminal structures equipped with the antenna structures according to other embodiments of the present invention will now be described with reference to FIGS. 6 to 14B. In the following description, the same members of the mobile terminal structure as shown in FIGS. 2 to 5 are denoted by the same reference numerals so as to avoid an overlapping description.

Figure 6:
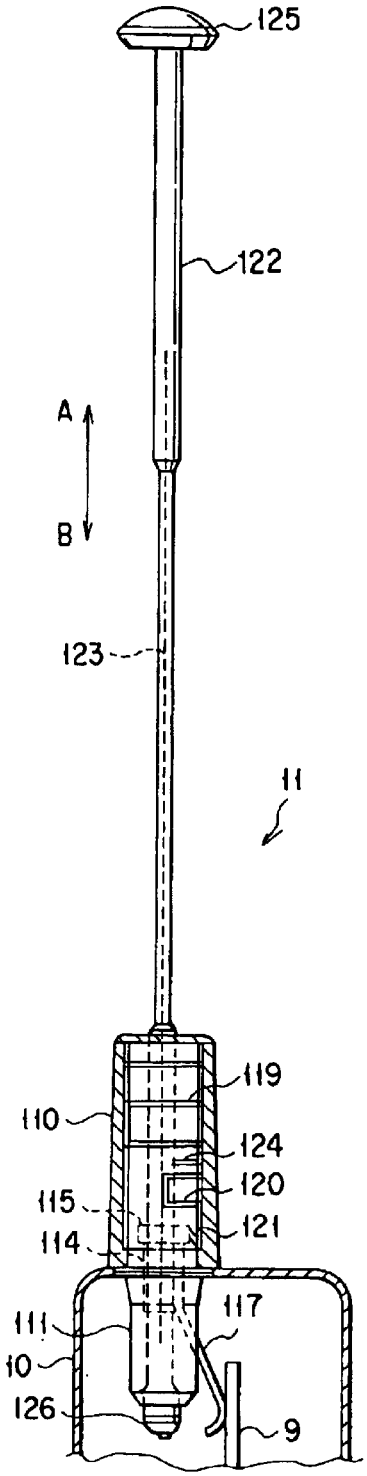
FIG. 6 is a cross sectional view, partly broken away, schematically showing a mobile terminal equipped with an antenna according to another embodiment of the present invention with the rod-like antenna extended.
Figure 7:
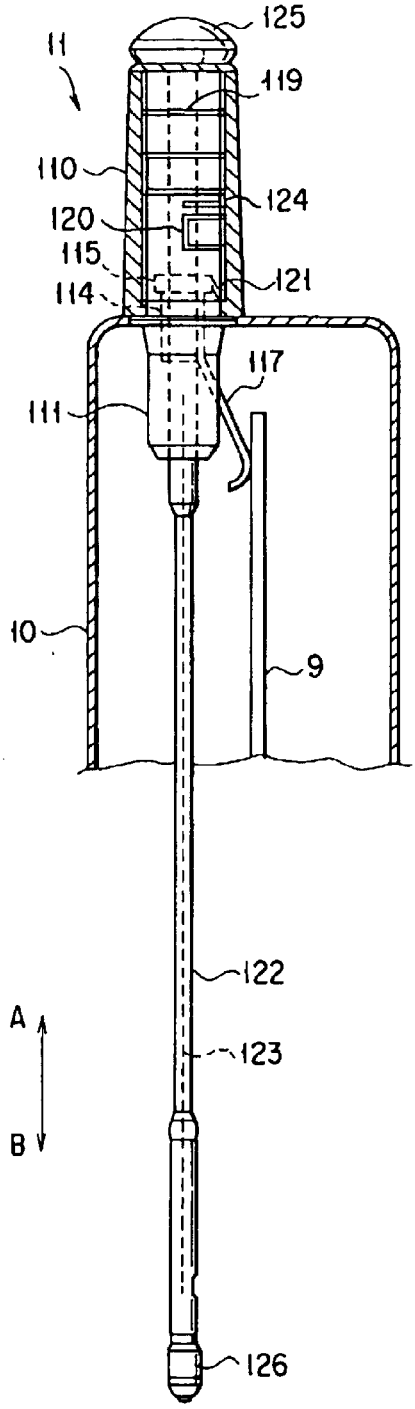
FIG. 7 is a cross sectional view, partly broken away, schematically showing the mobile terminal shown in FIG. 6 with the a rod-like antenna retracted in the body.

In the mobile terminal structure equipped with an antenna structure according to another embodiment of the present invention, which is shown in FIGS. 6 and 7, the linear antenna element 123 extends within the rod-like antenna 122 so as to reach a region in the vicinity of the second stopper 126. In the particular construction, any of the linear antenna element 123 and the meandering antenna element 119 formed on the flexible substrate 118 is coupled by the capacitive coupling with the matching circuit 120 whether the rod-like antenna 122 is extended or housed in the terminal body 10. In this structure, the capacitance is set to permit the capacitive coupling between the linear antenna element 123 and the matching circuit 120 to be substantially equal to the capacitive coupling between the meandering antenna element 119 formed on the flexible substrate 118 and the matching circuit 120.

In this structure, resonance takes place between the linear antenna element 123 and the meandering antenna 119 formed on the flexible substrate 118 whether the rod-like antenna 122 is extended or retracted in the terminal body 10, so as to further increase the band width.

Also, in the antenna structure shown in FIGS. 6 and 7, it is possible for the linear antenna element 123 to be coupled together with the meandering antenna element 119 with the matching circuit 120 formed on the flexible substrate 118, by capacitive coupling when the rod-like antenna 122 is extended or retracted in the terminal body 10.

Figure 8:
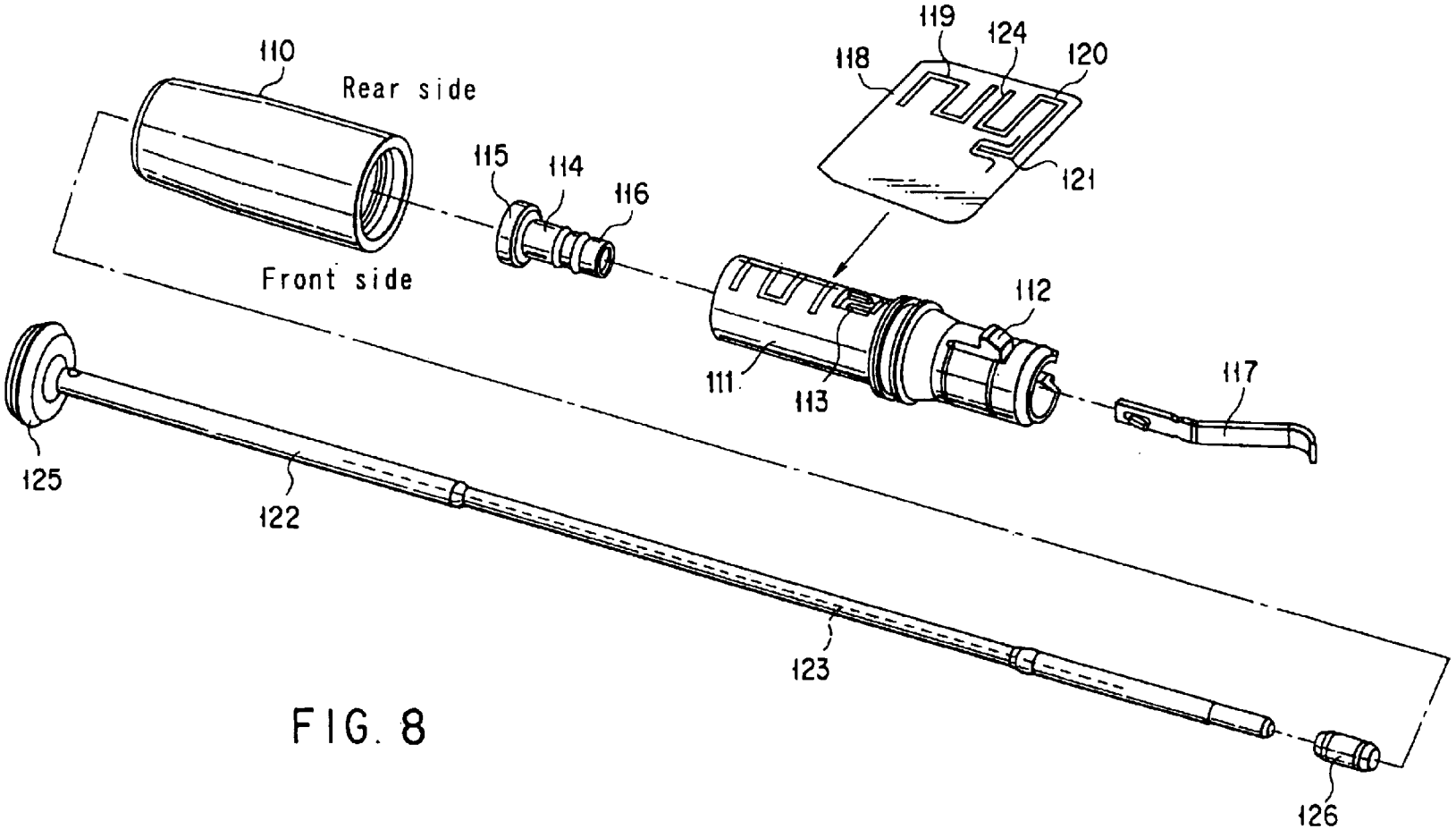
FIG. 8 is an oblique view schematically showing, in a dismantled fashion, the construction of the antenna shown in FIG. 6.
Figure 9:
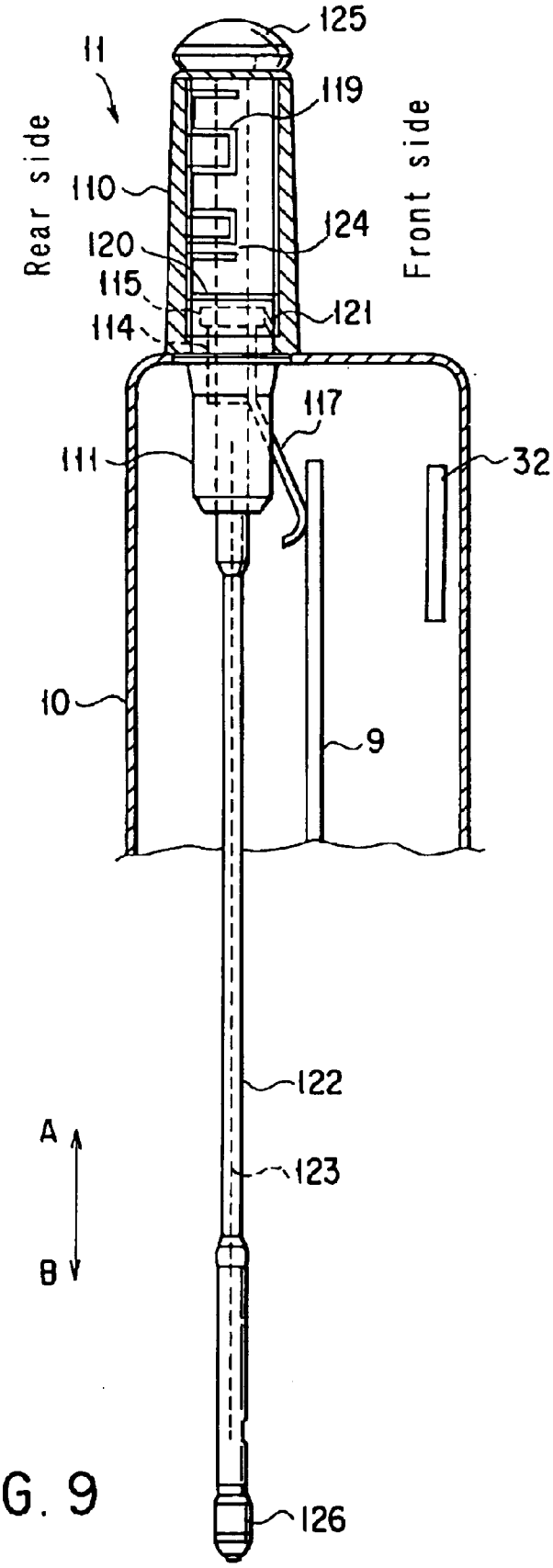
FIG. 9 is a cross sectional view, partly broken away, schematically showing the mobile terminal having the antenna structure shown in FIG. 8 with the rod-like antenna retracted in the mobile terminal.
Figure 10:
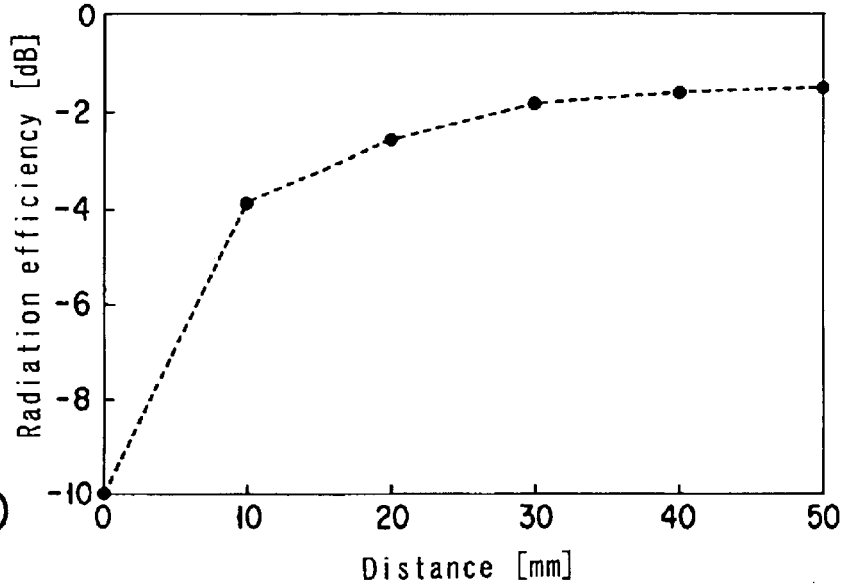
FIG. 10 is a graph showing the relationship between the radiation efficiency and the distance in the antenna structure shown in FIG. 8.

In the mobile terminal equipped with the antenna structure according to another embodiment of the present invention, which is shown in FIGS. 8 to 10, the user interface section such as the microphone 31 and the loud speaker 32 is arranged on the front side of the mobile terminal body 10, and the flexible substrate 118 is arranged at the rear side of the antenna cap 110, the rear side corresponding to the opposite side of the front side of the mobile terminal body 10. To be more specific, if the side facing the ear and the mouth of the user when the user uses the mobile terminal is defined to be the front side of the terminal body 10, the meandering antenna element 119 and the matching circuit 120 is arranged in the space on the rear side of the antenna cap 110 relative to the antenna axis, and the flexible substrate 118 is positioned within the antenna cap fixed to the terminal body 10 such that the flexible substrate 118 is positioned as remotely as possible from the user.

According to this construction, it is possible to satisfy the miniaturization of the terminal body 10 and to set maximum the distance L from the user making the telephone conversation, by utilizing the meandering antenna element 119 and the matching circuit 120 formed on the flexible substrate 118, the loud speaker 32, etc., under the state that the rod-like antenna 122 is housed in the terminal body 10. In other words, it is possible to improve the radiation efficiency of the meandering antenna element 119 formed on the flexible substrate 118, said radiation efficiency being determined by the distance L from the user under the state of using the terminal as shown in FIG. 10. It follows that it is possible to satisfy the miniaturization of the terminal body 10 and to set the distance L at a large value so as to improve easily the radiation efficiency.

Figure 12:
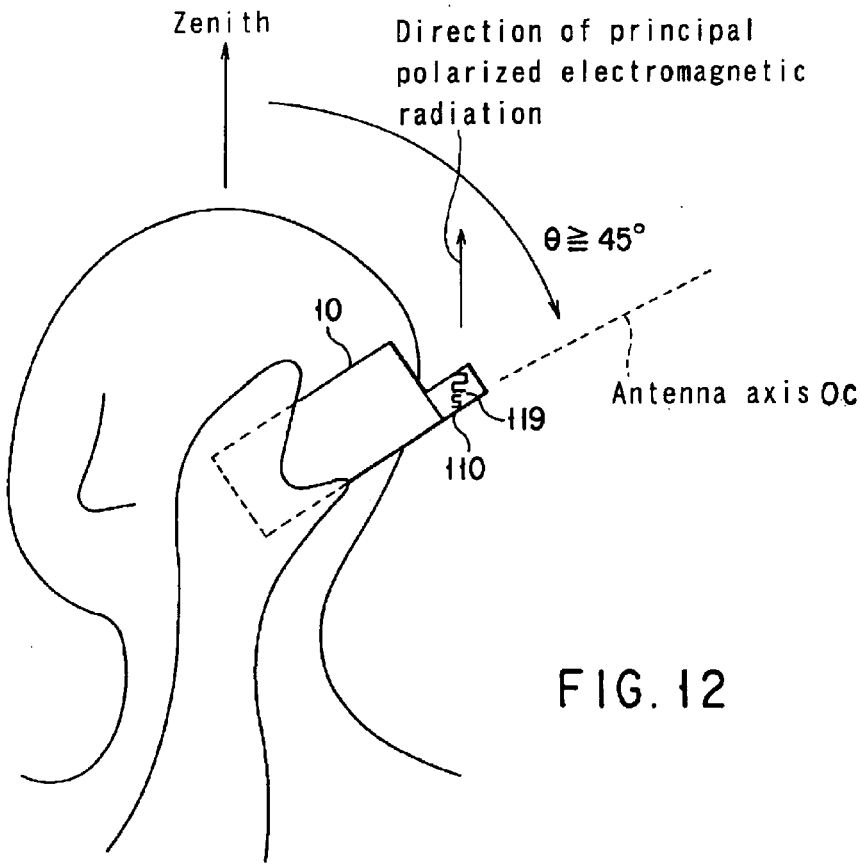
FIG. 12 schematically shows the relationship between the direction of the antenna axis and the direction of a principal polarized electromagnetic radiation during use of the mobile terminal having the antenna shown in FIG. 11.
Figure 11:
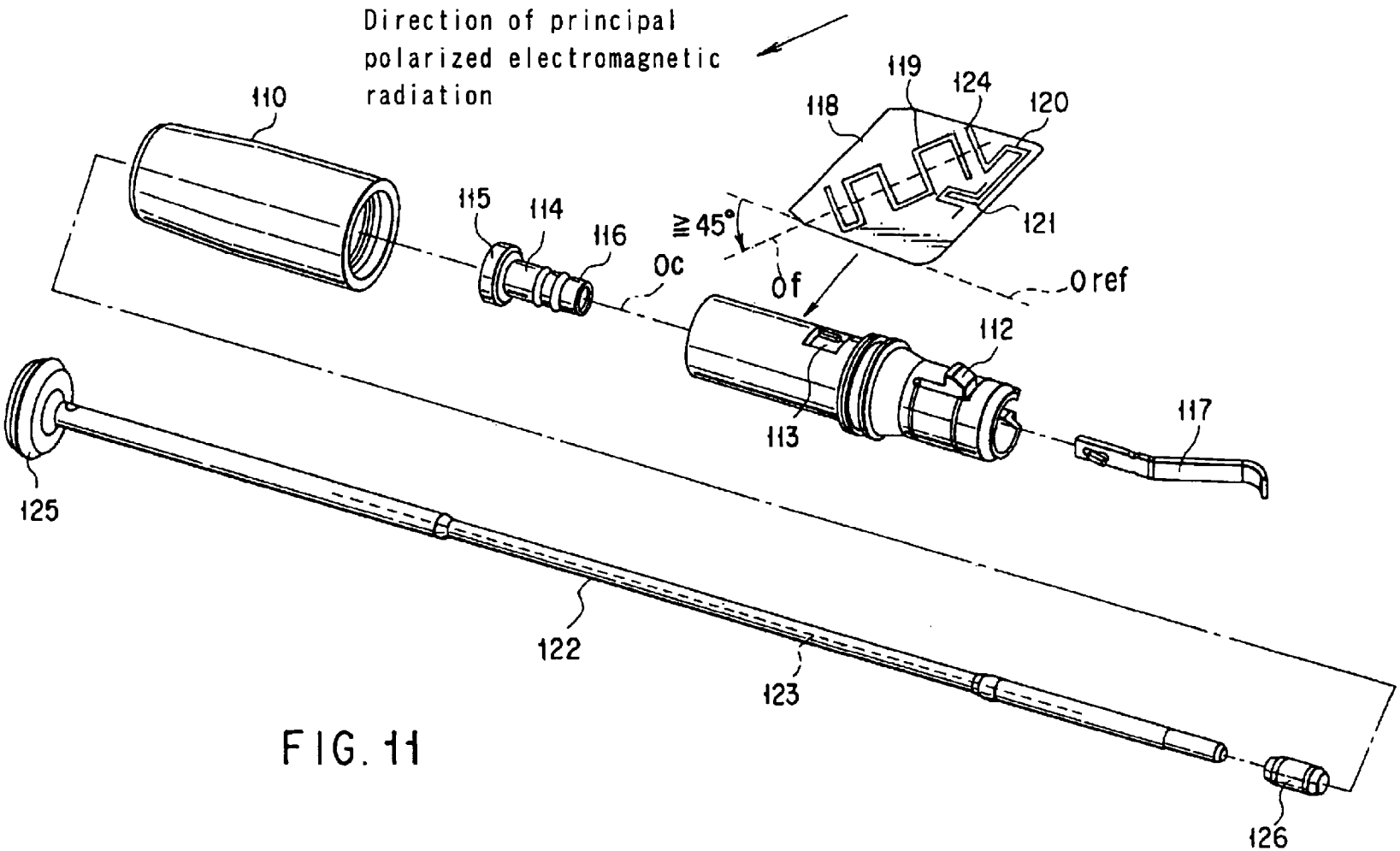
FIG. 11 is an oblique view schematically showing, in a dismantled fashion, an antenna according to another embodiment of the present invention.

FIGS. 11 and 12 collectively show a mobile terminal equipped with an antenna structure according to another embodiment of the present invention. In this embodiment, the flexible substrate 118 is mounted within the antenna cap 110 such that the angle θ made between an axis Ox of the meandering antenna element 119 and the matching circuit 120 and a reference axis Oref parallel to the antenna axis Oc falls within a range of between about 45° and 90°. Preferably, the angle θ noted above should be about 60°. If the mobile terminal is used normally, the reference axis Oref is substantially coincident with the direction of the principal polarized electromagnetic radiation, as shown in FIG. 12, although the situation depends on the mode of use of the mobile terminal.

According to the antenna structure described above, the meandering antenna element 119 and the matching circuit 120 are inclined by at least about 45° relative to the antenna axis, as shown in FIG. 12. As a result, during a telephone conversation, the meandering antenna element 119 faces in the direction of the principal polarized electromagnetic radiation (zenith) so as to make it possible to receive with a high efficiency vertically-polarized electromagnetic radiation waves transmitted from the radio station, or to transmit with a high efficiency, the vertically-polarized electromagnetic wave to the radio station. It follows that it is possible to realize a simple and a highly efficient telephone by using the meandering antenna element 119.

Figure 13:
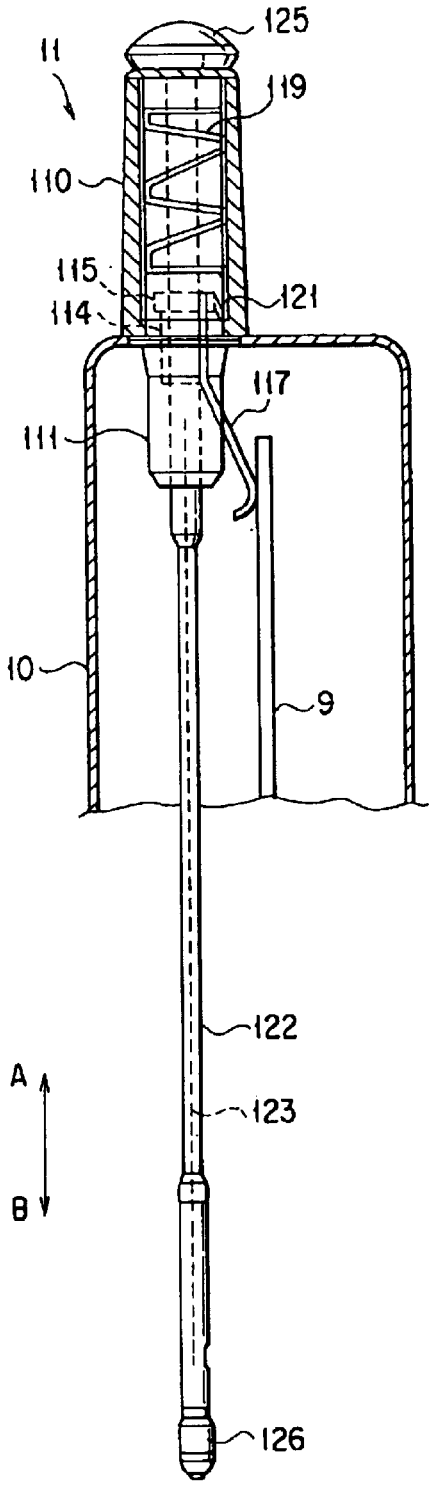
FIG. 13 is a cross sectional view, partly broken away, schematically showing the mobile terminal having an antenna according to another embodiment of the present invention.

In the antenna structures according to the embodiments shown in FIGS. 2 to 12, the meandering antenna element 119 and the matching circuit 120 are formed on a single flexible substrate 118. However, in the mobile terminal equipped with an antenna structure according to another embodiment of the present invention, which is shown in FIG. 13, the meandering antenna element 119 alone is formed on the flexible substrate 118, and the meandering antenna element 119 is coupled directly with the sleeve 114 through the capacitive coupling. Also, in the embodiment shown in FIG. 13, one end of the power supply pin 117 connected to the radio transmission section 1 is electrically connected to the sleeve 114 so that the power supply pin 117 performs the function of the matching circuit 120.

According to the construction described above, it suffices to form the meandering antenna element 119 alone on the flexible substrate 118 so as to simplify the construction of the flexible substrate 118.

Figure 14A:
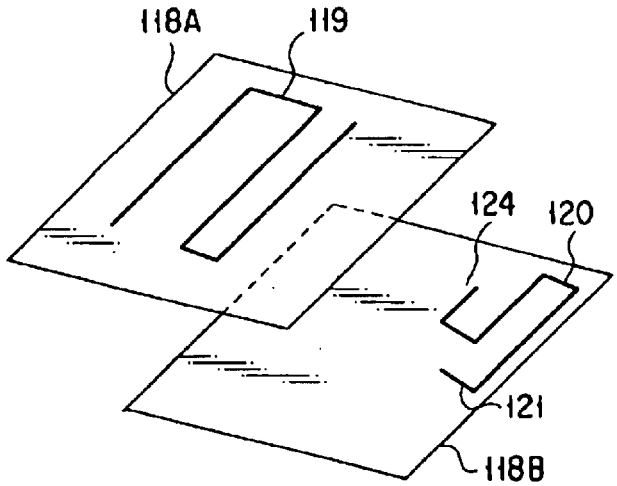
FIGS. 14A and 14B are oblique views each schematically showing a modification of a flexible substrate structure applicable to the antenna structure shown in FIG. 2.

FIG. 14A shows another embodiment of the present invention. In this case, two flexible substrates 118A and 118B having the meandering antenna element 119 and the matching circuit 120 formed thereon, respectively, are bonded to each other with the positions of the substrates 118A and 118B aligned appropriately, in place of using a single flexible substrate 118 having both the meandering antenna element 119 and the matching circuit 120 formed thereon. In this bonding structure, the capacitive coupling section 124 is formed in the bonding portion of the flexible substrates 118A and 118B.

Figure 14B:
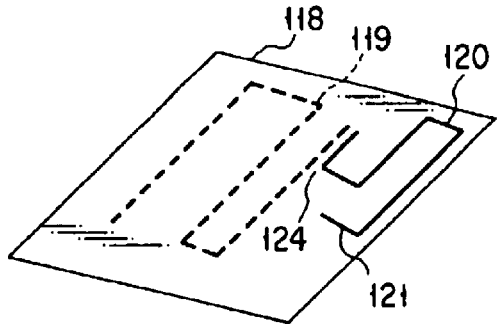

FIG. 14B shows still another embodiment of the present invention. In this case, the meandering antenna element 119 is formed on one surface of a single flexible substrate 118, and the matching circuit 120 is formed on the other surface of the flexible substrate 118.

In each of the embodiments described above, each of the antenna element 119 and the matching circuit 120 are formed on the flexible substrate 118 in a meandering pattern. However, the patterns of the antenna element 119 and the matching circuit 120 need not be limited to the meandering pattern. It is possible for the antenna element 119 and the matching circuit 120 to be of various other patterns.

In each of the embodiments described above, the technical idea of the present invention is applied to the retractable antenna of the bottom helical structure. However, it is also possible to apply the technical idea of the present invention to the top helical structure constructed to pull up the antennas including the antenna used when the antenna is extended or retracted, with substantially the same effect.

Additional advantages and modifications will readily occur to those skilled in the art. Therefore, the present invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An antenna structure configured to be arranged in a mobile radio apparatus having a radio unit for transmitting and receiving a radio signal, comprising:

an extensible antenna;

a flexible substrate arranged around the extensible antenna;

an antenna pattern formed on the flexible substrate; and a matching circuit formed on the flexible substrate, the matching circuit being configured to be continuously capacitivley coupled with the antenna pattern, wherein the extensible antenna and the matching circuit are further configured to be capacitivley coupled together only when the extensible antenna is extended from the radio unit.

2. The antenna structure according to claim 1, wherein the extensible antenna has a distal end which is electrically connected to the matching circuit when the extensible antenna is extended from the radio unit and is electrically disconnected from the matching circuit when the extensible antenna is retracted into the radio unit.

3. A mobile radio apparatus comprising:

a case;

a rod antenna;

an antenna supporting unit configured to enable the rod antenna to be extracted out of and retracted into the case a flexible substrate arranged around the antenna supporting unit;

an antenna pattern formed on the flexible substrate;

a radio unit configured to transmit and receive a radio signal; and a matching circuit formed on the flexible substrate, the matching circuit being configured to be continuously capacitivley coupled with the antenna pattern, wherein the rod antenna and the matching circuit are configured to capacitivley couple the rod antenna and matching circuit together only when the rod antenna is extended from the case.

4. The mobile radio apparatus according to claim 3, wherein the case comprises a front side and a rear side, the apparatus further comprising:

a loudspeaker arranged on the front side of the case, the antenna pattern being arranged on the same side of the flexible substrate as the rear side of the case.

5. The mobile radio apparatus according to claim 3, wherein the rod antenna element has a distal end which is electrically connected to the matching circuit when the rod antenna is extended from the case and is electrically disconnected from the matching circuit when the extensible antenna is retracted into the case.

6. A mobile radio apparatus comprising:

a case;

a rod antenna having a first central axis;

an antenna supporting unit configured to enable the rod antenna to be extracted out of and retracted into the case;

a flexible substrate arranged around the antenna supporting unit;

an antenna pattern formed on the flexible substrate and having a second central axis, the first central axis and the second central axis crossing at an angle in the range of 45° to 90°;

a radio unit configured to transmit and receive a radio signal; and a matching circuit formed on the flexible substrate, the matching circuit being configured to be continuously capacitively coupled with the antenna pattern, wherein the rod antenna and the matching circuit are configured to capacitively couple the rod antenna and matching circuit together only when the rod antenna is extended from the case.

7. The mobile radio apparatus according to claim 6, wherein the rod antenna element has a distal end which is electrically connected to the matching circuit when the rod antenna is extended from the case and is electrically disconnected from the matching circuit when the extensible antenna is retracted into the case.

8. The mobile radio apparatus according to claim 6, wherein the angle is substantially equal to 60°.

* * * * *